US010965017B2

(12) United States Patent
Descloux et al.

(10) Patent No.: US 10,965,017 B2
(45) Date of Patent: Mar. 30, 2021

(54) CONTINUOUS DIELECTRIC CONSTANT ADAPTATION RADOME DESIGN

(71) Applicant: SAINT-GOBAIN PERFORMANCE PLASTICS CORPORATION, Solon, OH (US)

(72) Inventors: Delphine Descloux, Paris (FR); Simon Mazoyer, Paris (FR); Emmanuel Mimoun, Boulogne-Billancourt (FR)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 0 days.

(21) Appl. No.: 16/716,069

(22) Filed: Dec. 16, 2019

(65) Prior Publication Data

US 2020/0212557 A1 Jul. 2, 2020

Related U.S. Application Data

(60) Provisional application No. 62/786,057, filed on Dec. 28, 2018.

(51) Int. Cl.
*H01Q 1/42* (2006.01)

(52) U.S. Cl.
CPC ..... *H01Q 1/422* (2013.01); *H01Q 1/42* (2013.01); *H01Q 1/421* (2013.01)

(58) Field of Classification Search
CPC ..... H01Q 1/422; H01Q 1/421; H01Q 1/42; H01Q 1/405; H01Q 1/427; H01Q 1/428; H01Q 19/06
See application file for complete search history.

(56) References Cited

U.S. PATENT DOCUMENTS 4,725,475 A 2/1988 Fiscus et al.
6,483,481 B1 11/2002 Sievenpiper et al.
(Continued)

FOREIGN PATENT DOCUMENTS

KR 10-2012-0027985 A 3/2012

OTHER PUBLICATIONS

International Search Report and Written Opinion for PCT/US2019/066610, dated Apr. 21, 2020, 9 pages.
(Continued)

*Primary Examiner* — Vibol Tan
(74) *Attorney, Agent, or Firm* — Abel Schillinger, LLP; J. Adrian Lawrence

(57) ABSTRACT

A radome may include a core and an outer dielectric constant (ODC) adaptation component overlying an outer surface of the core. The radome may have an effective dielectric constant variation profile from an outer surface of the ODC adaptation component, through the ODC adaptation component to an outer surface of the core. The effective dielectric constant variation profile of the ODC adaptation component may be a continuous monotonic function $DC_{(ot)}$, where $DC_{(ot)}$ is the dielectric constant of the ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

20 Claims, 5 Drawing Sheets

(56) References Cited

U.S. PATENT DOCUMENTS

| | | | | |
|---|---|---|---|---|
| 7,071,888 | B2 | 7/2006 | Sievenpiper | |
| 7,154,451 | B1 | 12/2006 | Sievenpiper | |
| 9,123,998 | B1 | 9/2015 | Lore | |
| 9,257,743 | B2 * | 2/2016 | Brady | H01Q 5/22 |
| 10,050,340 | B2 * | 8/2018 | Merk | H01Q 1/288 |
| 10,128,566 | B2 * | 11/2018 | Seghi | H01Q 1/427 |
| 2004/0246195 | A1 | 12/2004 | Usami et al. | |
| 2011/0050370 | A1 | 3/2011 | Lee et al. | |
| 2020/0212556 | A1 * | 7/2020 | Moore | B32B 5/32 |

OTHER PUBLICATIONS

Y.M. Pei et al., Progress in Electromagnetics Research, 2012, vol. 122, pp. 437-452: Dual-band radome wall with alternating layers of staggered composite and Kagome lattice structure.

P.E. Ransom, Thesis Dissertation: Wideband Structural and Ballistic Radome Design Using Subwavelength Textured Surfaces, 2016, The Catholic University of America.

S. Chattopadhyay et al., Materials Science and Engineering, R69, 2010, pp. 1-35: Anti-reflecting and photonic nanostructures. Index adaptation in optics for visible wavelength range applications.

* cited by examiner

CONTINUOUS DIELECTRIC CONSTANT ADAPTATION RADOME DESIGN

CROSS-REFERENCE TO RELATED APPLICATION(S)

This application claims priority under 35 U.S.C. § 119(e) to U.S. Provisional Patent Application No. 62/786,057, entitled "CONTINUOUS DIELECTRIC CONSTANT ADAPTATION RADOME DESIGN," by Delphine DESCLOUX et al., filed Dec. 28, 2018, which is assigned to the current assignee hereof and is incorporated herein by reference in its entirety.

FIELD OF THE DISCLOSURE

The present disclosure relates radome structure, and more particularly to the use of a dielectric constant adaptation component to minimize electromagnetic degradation caused by the radome on electromagnetic waves.

BACKGROUND

Airborne satcom radomes are generally protective covers for satellite antennas that are placed on an aircraft roof. Such radomes generally include at least one dielectric stack designed to optimize the radome's radio frequency transparency. The dielectric stack is a succession of high and low dielectric index materials and the thicknesses of these layers can be chosen to minimize the transmission losses of the radome at specific incident angle and specific frequencies. An optimal dielectric stack would transmit the entire range of incident electromagnetic waves without any absorption or reflection. Moreover the need for broadband radome designs is growing with the development of broadband antennas in the satcom frequency range (i.e., 1-40 GHz) and radar systems range (i.e., 40-100 GHz).

SUMMARY

According to a first aspect, a radome may include a core and an outer dielectric constant (ODC) adaptation component overlying an outer surface of the core. The radome may have an effective dielectric constant variation profile from an outer surface of the ODC adaptation component, through the ODC adaptation component to an outer surface of the core. The effective dielectric constant variation profile of the ODC adaptation component may be a continuous monotonic function $DC_{(ot)}$, where $DC_{(ot)}$ is the dielectric constant of the ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

According to still other aspects, a radome may include a core and an outer dielectric constant (ODC) adaptation component overlying an outer surface of the core. The ODC adaptation component may include an outer dielectric stack having N dielectric layers, where the N dielectric layers have varying dielectric constants $ODC_{(N)}$. The dielectric constants $ODC_{(N)}$ of each successive layer from an outer most dielectric layer to a dielectric layer contacting the outer surface of the core may increase from the dielectric constant of air $ODC_{(A)}$ to the dielectric constant of the core $ODC_{(C)}$ according to a continuous monotonic function $ODC_{(N)}$, where $ODC_{(N)}$ is the dielectric constant of a given Nth dielectric layer, where N is the dielectric layer number counting inwards from the outside of the ODC adaptation component.

According to yet other aspects, a radome may include a core and an outer dielectric constant (ODC) adaptation component overlying an outer surface of the core. The ODC adaptation component may include a textured outer surface of the core. The textured outer surface may include a pyramidal profile having a period p and a height h. The textured outer surface may be configured to create an effective dielectric constant variation profile. The effective dielectric constant variation profile created by the textured outer surface may be a continuous monotonic function $DC_{(ot)}$, where $DC_{(ot)}$ is the dielectric constant of the ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

BRIEF DESCRIPTION OF THE DRAWINGS

Embodiments are illustrated by way of example and are not limited to the accompanying figures.

Figure 1A:
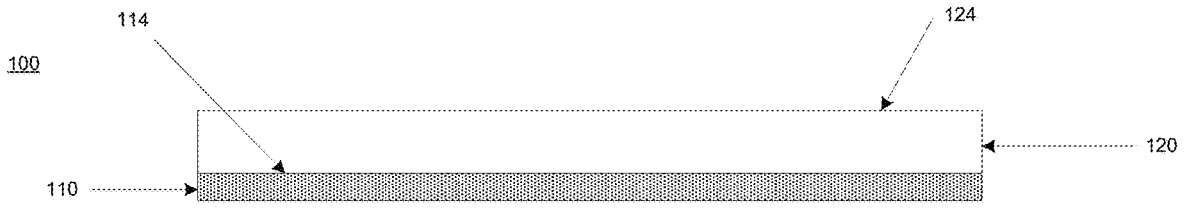
FIG. 1*a* includes an illustration of a radome structure according to an embodiment described herein.

Skilled artisans appreciate that elements in the figures are illustrated for simplicity and clarity and have not necessarily been drawn to scale.

DETAILED DESCRIPTION

The following discussion will focus on specific implementations and embodiments of the teachings. The detailed description is provided to assist in describing certain embodiments and should not be interpreted as a limitation on the scope or applicability of the disclosure or teachings. It will be appreciated that other embodiments can be used based on the disclosure and teachings as provided herein.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Embodiments described herein are generally directed to a radome having a varying index adaptation that minimizes reflections and allows for maximum transmission for both brad frequency ranges and broad incident angle ranges. In particular, embodiments described herein are generally directed to a radome that includes a core and at least an outer dielectric constant (ODC) adaptation component overlying an outer surface of the core. According to certain embodiments, the ODC adaptation component is configured to create generally smooth or continuous effective dielectric constant variation profile moving from the outer surface of the ODC adaptation component to the intersection between the ODC adaptation component and the outer surface of core.

It will be appreciated that for purposes of embodiments described herein, the phrase "effective dielectric constant variation profile" is the mathematical description of the effective change in dielectric constants through the thickness of the ODC adaption component. It will be further appreciated that the effective change in dielectric constants through the thickness of the ODC adaptation component may correspond to actual changes in the dielectric constants of material layers making up the ODC adaptation component (i.e., changes in the layers material composition or thickness), or the effective change in dielectric constants through the thickness of the ODC adaptation component may correspond to a surface texture of the ODC adaptation component that behaves (i.e., creates the same affect on transmissions through the radome) like a component with actual changes in the dielectric constants of material layers making up the ODC adaptation component.

For purposes of illustration, FIG. 1*a* includes an illustration of a radome 100 according to embodiments described herein. As shown in FIG. 1*a*, the radome 100 may include a core 110 having an outer surface 114 and an outer dielectric constant (ODC) adaptation component 120 overlying the outer surface 114 of the core 110. According to certain embodiments, the ODC adaptation component 120 may have an outer surface 124. According to still other embodiments, the ODC adaptation component 120 may have an effective dielectric constant variation profile from the outer surface 124 of the ODC adaptation component 120 to the outer surface 114 of the core 110.

According to certain embodiments, the effective dielectric constant variation profile of the ODC adaptation component 120 may be a continuous monotonic function $DC_{(ot)}$, where $DC_{(ot)}$ is the dielectric constant of the ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

According to particular embodiments, the radome 100 may have a particular incident angle reflection loss as measured according to RTCA DO-213 over an incident angle range between 0° and 60°. For example, the radome 100 may have an incident angle reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to yet other embodiments, the radome 100 may have a particular frequency range reflection loss as measured according to RTCA DO-213 over a 40 GHz frequency range. For example, the radome 100 may have a frequency range reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to still other embodiments, the continuous monotonic function $DC_{(ot)}$ may have a step change within a distance $OT_L$ less than 0.5*c/f, where c is the speed of light, and f is the largest operating frequency of the system.

According to yet other embodiments, the continuous monotonic function $DC_{(ot)}$ may have a step change within a particular distance $OT_L$. For example, the continuous monotonic function $DC_{(ot)}$ may have a step change within a distance $OT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm, such as, not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or even not greater than about 0.1 mm. According to still other embodiments, the continuous monotonic function $DC_{(ot)}$ may have a step change within a distance $OT_L$ of at least about 0.001 mm, such as, at least about 0.005 mm or at least about 0.01 mm or even at least about 0.05 mm. It will be appreciated that the continuous monotonic function $DC_{(ot)}$ may have a step change within a distance $OT_L$ within a range between any of the minimum and maximum values noted above. It will be further appreciated that the continuous monotonic function $DC_{(ot)}$ may have a step change within a distance $OT_L$ of any value between any of the minimum and maximum values noted above.

According to yet other embodiments, the continuous monotonic function $DC_{(ot)}$ may be a function $DC_{(ot)}=[DC_0^{1/2}+(DC_S^{1/2}-DC_0^{1/2})\cdot ot]^2$ where $DC_s$ is the dielectric constant of the core and $DC_0$ is the dielectric constant of the medium containing the radome.

According to still other embodiments, the continuous monotonic function $DC_{(ot)}$ is a function $DC_{(ot)}=[DC_0^{1/2}+(DC_S^{1/2}-DC_0^{1/2})\cdot(A\cdot ot+B\cdot ot^2+C\cdot ot^3)]^2$, with $A+B+C=1$ where $DC_s$ is the dielectric constant of the core and $DC_0$ is the dielectric constant of the medium containing the radome.

According to yet other embodiments, the continuous monotonic function $DC_{(ot)}$ is a function $DC_{(ot)}=[DC_0^{1/2}+(DC_S^{1/2}\ DC_0^{1/2})\cdot(D\cdot ot^3+E\cdot ot^4+F\cdot ot^5)]^2$, with $D+E+F=1$ where $DC_s$ is the dielectric constant of the core and $DC_0$ is the dielectric constant of the medium containing the radome.

According to certain embodiments, the ODC adaptation component 120 may include an outer dielectric stack overlying the outer surface 114 of the core 110. According to particular embodiments, the outer dielectric stack may be configured to follow the effective dielectric constant variation profile of the ODC adaptation component 120.

According to yet another embodiment, the ODC adaptation component 120 may include a textured outer surface 114 of the core 110. According to particular embodiments, the textured outer surface 114 may be configured to create the effective dielectric constant variation profile of the ODC adaptation component 120.

According to yet another embodiment, a radome as generally described herein may include a core, an outer dielectric constant (ODC) adaptation component overlying an outer surface of the core, and an inner dielectric constant (IDC) adaptation component overlying an inner surface of the core. According to certain embodiments, the IDC adaptation component is configured to create a generally smooth or continuous effective dielectric constant variation profile moving from the outer surface of the IDC adaptation component to the intersection between the IDC adaptation component and the inner surface of the core. According to still other embodiments, the IDC adaptation component is configured to create generally smooth or continuous effective dielectric constant variation profile moving from the intersection between the inner surface of the core and the IDC adaptation component to the outer surface of the IDC adaptation component.

Figure 1B:
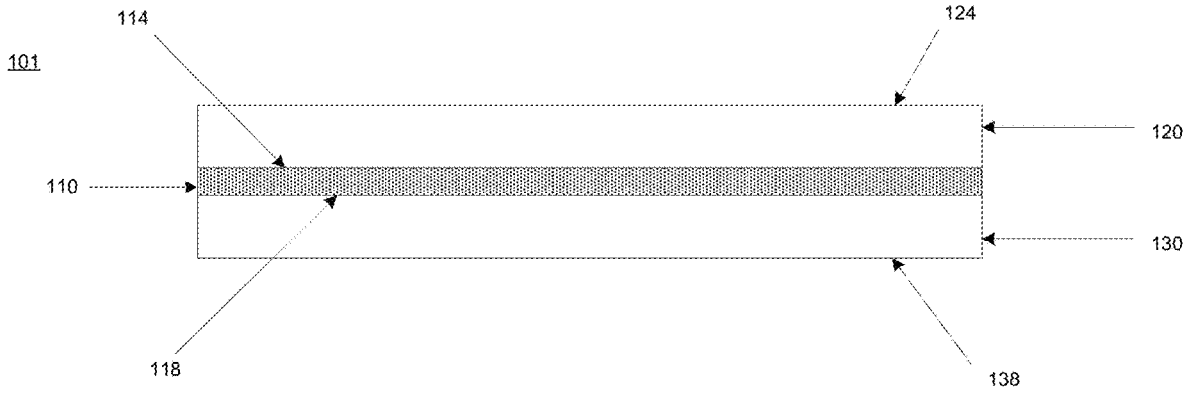
FIG. 1*b* includes an illustration of a radome structure according to another embodiment described herein.

For purposes of illustration, FIG. 1*b* includes an illustration of a radome 101 according to embodiments described herein. As shown in FIG. 1*b*, the radome 101 may include a core 110 having an outer surface 114 and an inner surface 118, an outer dielectric constant (ODC) adaptation component 120 overlying the outer surface 114 of the core 110, and an inner dielectric constant (IDC) adaptation component 130 overlying the inner surface 118 of the core 110. The ODC adaptation component 120 may have an outer surface 124 and the IDC adaptation component 130 may have an inner surface 138. The ODC adaptation component 120 may have an effective dielectric constant variation profile from the outer surface 124 to the outer surface 114 of the core 110. The IDC adaptation component 130 may have an effective dielectric constant variation profile from the inner surface 118 of the core 110 to the inner surface 138 of the IDC adaptation component 130.

It will be appreciated that the radome 101 and all components described in reference to the radome 101 as shown in FIG. 1*b* may have any of the characteristics described herein with reference to corresponding components shown in FIG. 1*a*. In particular, the characteristic of radome 101, core 110, outer surface 114, ODC adaptation component 120 and outer surface 124 as shown in FIG. 1*b* may have any of the corresponding characteristics described herein in reference to radome 101, core 110, outer surface 114, ODC adaptation component 120 and outer surface 124 as shown in FIG. 1*a*.

According to certain embodiments, the effective dielectric constant variation profile of the IDC adaptation component 130 may be a continuous monotonic function $DC_{(it)}$, where $DC_{(it)}$ is the dielectric constant of the IDC adaptation component at the value it, where it is a ratio $IT_L/IT_T$, $IT_L$ is a location within the IDC variation component measured from the inner surface of the IDC variation component, and $IT_T$ is the total thickness of the IDC adaptation.

According to particular embodiments, the radome 101 may have a particular incident angle reflection loss as measured according to ASTM #RTCA DO-213 over an incident angle range between 0° and 60°. For example, the radome 100 may have an incident angle reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to yet other embodiments, the radome 101 may have a particular frequency range reflection loss as measured according to RTCA DO-213 over a 40 GHz frequency range. For example, the radome 100 may have a frequency range reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to still other embodiments, the continuous monotonic function $DC_{(it)}$ may have a step change within a distance $IT_L$ less than 0.5*c/f, where c is the speed of light, and f is the largest operating frequency of the system.

According to yet other embodiments, the continuous monotonic function $DC_{(it)}$ may have a step change within a particular distance $IT_L$. For example, the continuous monotonic function $DC_{(it)}$ may have a step change within a distance $IT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm, such as, not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or even not greater than about 0.1 mm. According to still other embodiments, the continuous monotonic function $DC_{(it)}$ may have a step change within a distance $IT_L$ of at least about 0.001 mm, such as, at least about 0.005 mm or at least about 0.01 mm or even at least about 0.05 mm. It will be appreciated that the continuous monotonic function $DC_{(it)}$ may have a step change within a distance $IT_L$ within a range between any of the minimum and maximum values noted above. It will be further appreciated that the continuous monotonic function $DC_{(it)}$ may have a step change within a distance $IT_L$ of any value between any of the minimum and maximum values noted above.

According to yet other embodiments, the continuous monotonic function $DC_{(it)}$ may be a function $DC_{(it)}=[DC_0^{1/2}+(DC_S^{1/2}\ DC_0^{1/2})\ it]^2$ where $DC_s$ is the dielectric constant of the core and $DC_0$ is the dielectric constant of the medium containing the radome.

According to still other embodiments, the continuous monotonic function $DC_{(it)}$ is a function $DC_{(it)}=[DC_0^{1/2}+(DC_s^{1/2}-DC_0^{1/2})\cdot(A\cdot it+B\cdot it^2+C\cdot it^3)]^2$, with A+B+C=1 where $DC_s$ is the dielectric constant of the core and $DC_0$ is the dielectric constant of the medium containing the radome.

According to yet other embodiments, the continuous monotonic function $DC_{(ot)}$ is a function $DC_{(it)}=[DC_0^{1/2}+(DC_s^{1/2}-DC_0^{1/2})\cdot(D\cdot it^3+E\cdot it^4+F\cdot it^5)]$, with D+E+F=1 where $DC_s$ is the dielectric constant of the core and $DC_0$ is the dielectric constant of the medium containing the radome.

According to certain embodiments, the IDC adaptation component 130 may include an inner dielectric stack overlying the inner surface of the core 110. According to particular embodiments, the inner dielectric stack may be configured to follow the effective dielectric constant variation profile of the IDC adaptation component.

According to yet another embodiment, the IDC adaptation component 130 may include a textured inner surface of the core 110. According to particular embodiments, the textured inner surface may be configured to create the effective dielectric constant variation profile of the IDC adaptation component.

According to yet another embodiment, a radome as generally described herein may include a core, and an outer dielectric constant (ODC) adaptation component overlying an outer surface of the core. According to certain embodiments, the ODC adaptation component may include an outer dielectric stack having N dielectric layers, where N refers to the layer number counting inward from the outside of the ODC adaptation component to the intersection between the ODC adaptation component and the outer surface of the core.

Figure 2A:
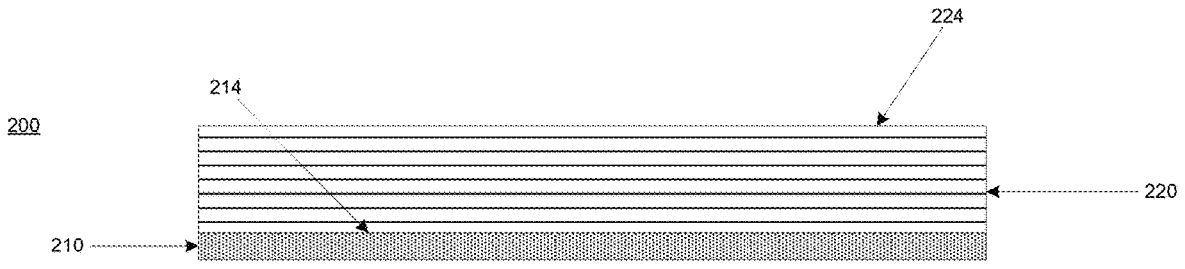
FIG. 2*a* includes an illustration of a radome structure according to another embodiment described herein.

For purposes of illustration, FIG. 2*a* includes an illustration of a radome 200 according to embodiments described herein. As shown in FIG. 2*a*, the radome 200 may include a core 210 having an outer surface 214 and an outer dielectric constant (ODC) adaptation component 220 overlying the outer surface 214 of the core 210. According to certain embodiments, the ODC adaptation component 220 may have an outer surface 224. According to still other embodiments, the ODC adaptation component 220 may include an outer dielectric stack 225 having N dielectric layers, where N refers to the layer number counting inward from the outer surface 224 of the ODC adaptation component 220 to the intersection between the ODC adaptation component 220 and the outer surface 214 of the core 210.

According to particular embodiments, each successive dielectric layer of the outer dielectric layer stack 225 may have a dielectric constant $ODC_{(N)}$. According to still other embodiments, the dielectric constants $ODC_{(N)}$ of each successive layer from an outer most dielectric layer $N_1$ to a dielectric layer $N_N$ contacting the outer surface 214 of the core 210 may increase from a dielectric constant of the medium containing the radome $ODC_{(M)}$ (i.e., air, water, etc.) to a dielectric constant of the core 210 $ODC_{(C)}$ according to a continuous monotonic function $ODC_{(N)}$, where $ODC_{(N)}$ is the dielectric constant of a $N^{th}$ dielectric layer.

According to particular embodiments, the radome 200 may have a particular incident angle reflection loss as measured according to RTCA DO-213 over an incident angle range between 0° and 60°. For example, the radome 200 may have an incident angle reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to yet other embodiments, the radome 200 may have a particular frequency range reflection loss as measured according to RTCA DO-213 over a 40 GHz frequency range. For example, the radome 200 may have a frequency range reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to still other embodiments, the continuous monotonic function $ODC_{(N)}$ may have a step change within a distance $OT_L$ less than 0.5*c/f, where c is the speed of light, and f is the largest operating frequency of the system.

According to yet other embodiments, the continuous monotonic function $ODC_{(N)}$ may have a step change within a particular distance $OT_L$. For example, the continuous monotonic function $ODC_{(N)}$ may have a step change within a distance $OT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm, such as, not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or even not greater than about 0.1 mm. According to still other embodiments, the continuous monotonic function $ODC_{(N)}$ may have a step change within a distance $OT_L$ of at least about 0.001 mm, such as, at least about 0.005 mm or at least about 0.01 mm or even at least about 0.05 mm. It will be appreciated that the continuous monotonic function $ODC_{(N)}$ may have a step change within a distance $OT_L$ within a range between any of the minimum and maximum values noted above. It will be further appreciated that the continuous monotonic function $ODC_{(N)}$ may have a step change within a distance $OT_L$ of any value between any of the minimum and maximum values noted above.

According to yet other embodiments, the continuous monotonic function $ODC_{(N)}$ may be a function $ODC_{(N)}=[ODC_0^{1/2}+(ODC_S^{1/2}-ODC_0^{1/2})\cdot N]^2$ where $ODC_S$ is the dielectric constant of the core and $ODC_0$ is the dielectric constant of the medium containing the radome.

According to still other embodiments, the continuous monotonic function $ODC_{(N)}$ may be a function $ODC_{(N)}=[ODC_0^{1/2}+(ODC_S^{1/2}-ODC_0^{1/2})\cdot(A\cdot N+B\cdot N^2+C\cdot N^3)]^2$, with $A+B+C=1$ where $ODC_s$ is the dielectric constant of the core and $ODC_0$ is the dielectric constant of the medium containing the radome.

According to yet other embodiments, the continuous monotonic function $ODC_{(N)}$ may be a function $ODC_{(N)}=[ODC_0^{1/2}+(ODC_S^{1/2}-ODC_0^{1/2})\cdot(D\cdot N^3+E\cdot N^4+F\cdot N^5)]^2$, with $D+E+F=1$ where $ODC_s$ is the dielectric constant of the core and $ODC_0$ is the dielectric constant of the medium containing the radome.

According to yet another embodiment, a radome as generally described herein may include a core, an outer dielectric constant (ODC) adaptation component overlying an outer surface of the core, and an inner dielectric constant (IDC) adaptation component overlying an inner surface of the core. According to certain embodiments, the ODC adaptation component may include an outer dielectric stack having N dielectric layers, where N refers to the layer number counting inward from the outside of the ODC adaptation component to the intersection between the ODC adaptation component and the outer surface of the core. According to still other embodiments, the IDC adaptation component may include an inner dielectric stack having N dielectric layers, where N refers to the layer numbers inwards from the inner surface of the core to an inner surface of the IDC adaptation component.

Figure 2B:
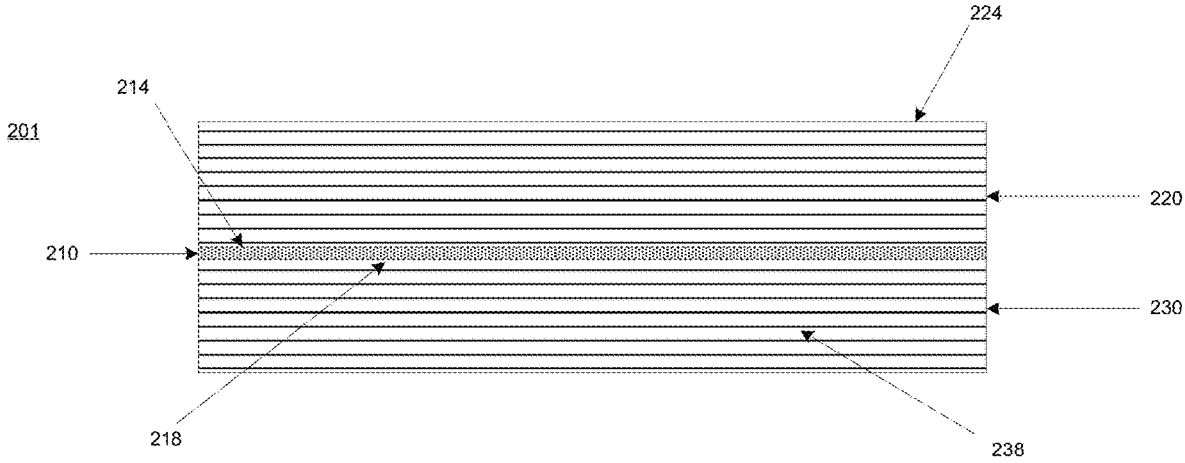
FIG. 2*b* includes an illustration of a radome structure according to another embodiment described herein.

For purposes of illustration, FIG. 2*b* includes an illustration of a radome 201 according to embodiments described herein. As shown in FIG. 2*b*, the radome 201 may include a core 210 having an outer surface 214 and an inner surface 218, an outer dielectric constant (ODC) adaptation component 220 overlying the outer surface 214 of the core 210, and an inner dielectric constant (IDC) adaptation component 230 overlying the inner surface 218 of the core 210. According to certain embodiments, the ODC adaptation component 220 may have an outer surface 224. According to still other embodiments, the ODC adaptation component 220 may include an outer dielectric stack 225 having N dielectric layers, where N refers to the layer number counting inward from the outer surface 224 of the ODC adaptation component 220 to the intersection between the ODC adaptation component 220 and the outer surface 214 of the core 210. According to certain embodiments, the IDC adaptation component 230 may have an inner surface 238. According to still other embodiments, the IDC adaptation component 230 may include an inner dielectric stack 235 having N dielectric layers, where N refers to the layer number counting inward from the inner surface 218 of the core 210 to the inner surface 238 of the IDC adaptation component 230.

It will be appreciated that the radome 201 and all components described in reference to the radome 201 as shown in FIG. 2*b* may have any of the characteristics described herein with reference to corresponding components shown in FIG. 2*a*. In particular, the characteristic of radome 201, core 210, outer surface 214, ODC adaptation component 220, outer surface 224 and outer dielectric stack 225 as shown in FIG. 2*b* may have any of the corresponding characteristics described herein in reference to radome 200, core 210, outer surface 214, ODC adaptation component 220, outer surface 224 and outer dielectric stack 225 as shown in FIG. 1*a*.

According to particular embodiments, each successive dielectric layer of the inner dielectric layer stack 235 may have a dielectric constant $IDC_{(N)}$. According to still other embodiments, the dielectric constants $IDC_{(N)}$ of each successive layer from an inner most dielectric layer $N_1$ to a dielectric layer $N_N$ contacting the inner surface 218 of the core 210 may increase from a dielectric constant of the core 210 $IDC_{(C)}$ to a dielectric constant of the medium containing the radome $IDC_{(M)}$ (i.e., air, water, etc.) according to a continuous monotonic function $IDC_{(N)}$, where $IDC_{(N)}$ is the dielectric constant of a $N^{th}$ dielectric layer.

According to particular embodiments, the radome 201 may have a particular incident angle reflection loss as measured according to RTCA DO-213 over an incident angle range between 0° and 60°. For example, the radome 201 may have an incident angle reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to yet other embodiments, the radome 201 may have a particular frequency range reflection loss as measured according to RTCA DO-213 over a 40 GHz frequency range. For example, the radome 200 may have a frequency range reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to still other embodiments, the continuous monotonic function $IDC_{(N)}$ may have a step change within a distance $IT_L$ less than 0.5*c/f, where c is the speed of light, and f is the largest operating frequency of the system.

According to yet other embodiments, the continuous monotonic function $IDC_{(N)}$ may have a step change within a particular distance $IT_L$. For example, the continuous monotonic function $IDC_{(N)}$ may have a step change within a distance $IT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm, such as, not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or even not greater than about 0.1 mm. According to still other embodiments, the continuous monotonic function $IDC_{(N)}$ may have a step change within a distance $IT_L$ of at least about 0.001 mm, such as, at least about 0.005 mm or at least about 0.01 mm or even at least about 0.05 mm. It will be appreciated that the continuous monotonic function $IDC_{(N)}$ may have a step change within a distance $IT_L$ within a range between any of the minimum and maximum values noted above. It will be further appreciated that the continuous monotonic function $IDC_{(N)}$ may have a step change within a distance $IT_L$ of any value between any of the minimum and maximum values noted above.

According to yet other embodiments, the continuous monotonic function $IDC_{(N)}$ may be a function $IDC_{(N)}=[IDC_0^{1/2}+(IDC_S^{1/2}-IDC_0^{1/2})\,N]^2$ where $IDC_s$ is the dielectric constant of the core and $IDC_0$ is the dielectric constant of the medium containing the radome.

According to still other embodiments, the continuous monotonic function $IDC_{(N)}$ may be a function $IDC_{(N)}=[IDC_0^{1/2}+(IDC_S^{1/2}-IDC_0^{1/2})\cdot(A\cdot N+B\cdot N^2+C\cdot N^3)]^2$, with $A+B+C=1$ where $IDC_s$ is the dielectric constant of the core and $IDC_0$ is the dielectric constant of the medium containing the radome.

According to yet other embodiments, the continuous monotonic function $ODC_{(N)}$ may be a function $IDC_{(N)}=[IDC_0^{1/2}+(IDC_S^{1/2}-IDC_0^{1/2})\cdot(D\cdot N^3+E\cdot N^4+F\cdot N^5)]^2$, with $D+E+F=1$ where $IDC_s$ is the dielectric constant of the core and $ODC_0$ is the dielectric constant of the medium containing the radome.

According to still another embodiment, a radome as generally described herein may include a core, and an outer dielectric constant (ODC) adaptation component overlying an outer surface of the core. According to certain embodiments, the ODC adaptation component may include a textured outer surface.

Figure 3A:
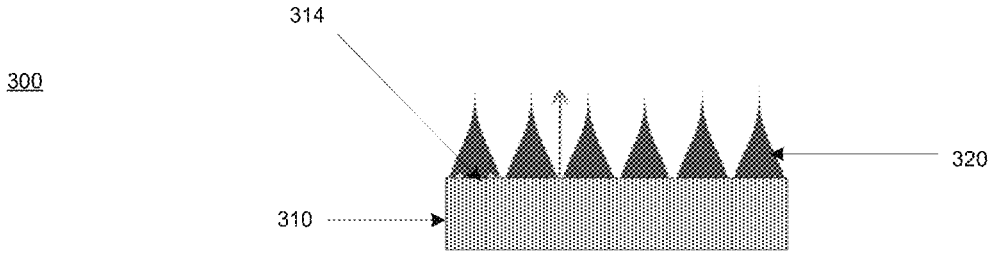
FIG. 3*a* includes an illustration of a radome structure according to another embodiment described herein.

For purposes of illustration, FIG. 3*a* includes an illustration of a radome 300 according to embodiments described herein. As shown in FIG. 3*a*, the radome 300 may include a core 310 having an outer surface 314 and an outer dielectric constant (ODC) adaptation component 320 overlying the outer surface 314 of the core 310. According to certain embodiments, the ODC adaptation component 320 may have a textured outer surface 324.

According to particular embodiments, the textured outer surface 324 of the ODC adaptation component 320 may include a pyramidal profile having a period p and a height h. According to yet other embodiments, the pyramidal profile of the textured outer surface 324 may be configured follow an effective dielectric constant variation profile of the ODC adaptation component. According to still other embodiments, the effective dielectric constant variation profile of the ODC adaptation component 320 may be continuous monotonic function $DC_{(ot)}$, where $DC_{(ot)}$ is the dielectric constant of ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

According to particular embodiments, the radome 300 may have a particular incident angle reflection loss as measured according to RTCA DO-213 over an incident angle range between 0° and 60°. For example, the radome 300 may have an incident angle reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to yet other embodiments, the radome 300 may have a particular frequency range reflection loss as measured according to RTCA DO-213 over a 40 GHz frequency range. For example, the radome 300 may have a frequency range reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to still other embodiments, the continuous monotonic function $DC_{(ot)}$ may have a step change within a distance $OT_L$ less than 0.5*c/f, where c is the speed of light, and f is the largest operating frequency of the system.

According to yet other embodiments, the continuous monotonic function $DC_{(ot)}$ may have a step change within a particular distance $OT_L$. For example, the continuous monotonic function $DC_{(ot)}$ may have a step change within a distance $OT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm, such as, not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or even not greater than about 0.1 mm. According to still other embodiments, the continuous monotonic function $DC_{(ot)}$ may have a step change within a distance $OT_L$ of at least about 0.001 mm, such as, at least about 0.005 mm or at least about 0.01 mm or even at least about 0.05 mm. It will be appreciated that the continuous monotonic function $DC_{(ot)}$ may have a step change within a distance $OT_L$ within a range between any of the minimum and maximum values noted above. It will be further appreciated that the continuous monotonic function $DC_{(ot)}$ may have a step change within a distance $OT_L$ of any value between any of the minimum and maximum values noted above.

According to yet other embodiments, the continuous monotonic function $DC_{(ot)}$ may be a function $DC_{(ot)}=[DC_0^{1/2}+(DC_s^{1/2}-DC_0^{1/2})\cdot ot]^2$ where $DC_s$ is the dielectric constant of the core and $DC_0$ is the dielectric constant of the medium containing the radome.

According to still other embodiments, the continuous monotonic function $DC_{(ot)}$ is a function $DC_{(ot)}=[DC_0^{1/2}+(DC_s^{1/2}-DC_0^{1/2})\cdot(A\cdot ot+B\cdot ot^2+C\cdot ot^3)]^2$, with $A+B+C=1$ where $DC_s$ is the dielectric constant of the core and $DC_0$ is the dielectric constant of the medium containing the radome.

According to yet other embodiments, the continuous monotonic function $DC_{(ot)}$ is a function $DC_{(ot)}=[DC_0^{1/2}+(DC_s^{1/2}-DC_0^{1/2})\cdot(D\cdot ot^3+E\cdot ot^4+F\cdot ot^5)]^2$, with $D+E+F=1$ where $DC_s$ is the dielectric constant of the core and $DC_0$ is the dielectric constant of the medium containing the radome.

According to yet another embodiment, a radome as generally described herein may include a core, an outer dielectric constant (ODC) adaptation component overlying an outer surface of the core, and an inner dielectric constant (IDC) adaptation component overlying an inner surface of the core. According to certain embodiments, the ODC adaptation component may include a textured outer surface. According to still other embodiments, the IDC adaptation component may include a textured inner surface.

Figure 3B:
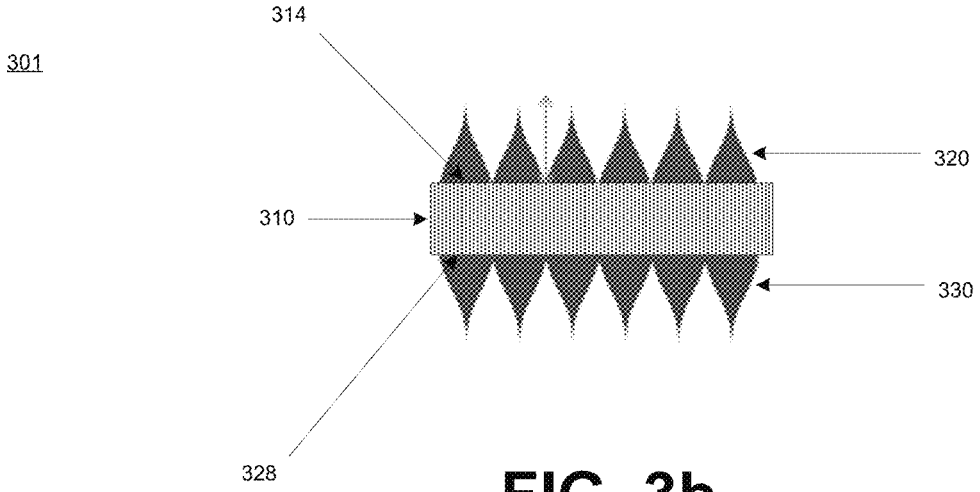
FIG. 3*b* includes an illustration of a radome structure according to another embodiment described herein.

For purposes of illustration, FIG. 3*b* includes an illustration of a radome 301 according to embodiments described herein. As shown in FIG. 3*b*, the radome 301 may include a core 310 having an outer surface 314 and an inner surface 318, an outer dielectric constant (ODC) adaptation component 320 overlying the outer surface 314 of the core 310 and an inner dielectric constant (IDC) adaptation component 330 overlying the inner surface 318 of the core 310. According to certain embodiments, the ODC adaptation component 320 may have a textured outer surface 324. According to other embodiments, the IDC adaptation component 320 may have a textured inner surface 338.

It will be appreciated that the radome 301 and all components described in reference to the radome 301 as shown in FIG. 3*b* may have any of the characteristics described herein with reference to corresponding components shown in FIG. 3*a*. In particular, the characteristic of radome 301, core 310, outer surface 114, ODC adaptation component 320 and textured outer surface 324 as shown in FIG. 3*b* may have any of the corresponding characteristics described herein in reference to radome 300, core 310, outer surface 314, ODC adaptation component 320 and textured outer surface 324 as shown in FIG. 3*a*.

According to particular embodiments, the textured inner surface 338 of the IDC adaptation component 330 may include a pyramidal profile having a period p and a height h. According to yet other embodiments, the pyramidal profile of the textured inner surface 338 may be configured to follow an effective dielectric constant variation profile of the IDC adaptation component 330. According to still other embodiments, the effective dielectric constant variation profile of the IDC adaptation component 330 may be a continuous monotonic function $DC_{(it)}$, where $DC_{(It)}$ is the dielectric constant of IDC adaptation component at the value it, where it is a ratio $IT_L/IT_T$, $IT_L$ is a location within the IDC variation component measured from the inner surface of the IDC variation component, and $IT_T$ is the total thickness of the IDC adaptation.

According to particular embodiments, the radome 301 may have a particular incident angle reflection loss as measured according to RTCA DO-213 over an incident angle range between 0° and 60°. For example, the radome 301 may have an incident angle reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to yet other embodiments, the radome 301 may have a particular frequency range reflection loss as measured according to RTCA DO-213 over a 40 GHz frequency range. For example, the radome 300 may have a frequency range reflection loss of not greater than about 3 dB, such as, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or even not greater than about 1.0 dB.

According to still other embodiments, the continuous monotonic function $DC_{(it)}$ may have a step change within a distance $IT_L$ less than 0.5*c/f, where c is the speed of light, and f is the largest operating frequency of the system.

According to yet other embodiments, the continuous monotonic function $DC_{(It)}$ may have a step change within a particular distance $IT_L$. For example, the continuous monotonic function $DC_{(it)}$ may have a step change within a distance $IT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm, such as, not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or even not greater than about 0.1 mm. According to still other embodiments, the continuous monotonic function $DC_{(it)}$ may have a step change within a distance $IT_L$ of at least about 0.001 mm, such as, at least about 0.005 mm or at least about 0.01 mm or even at least about 0.05 mm. It will be appreciated that the continuous monotonic function $DC_{(it)}$ may have a step change within a distance $IT_L$ within a range between any of the minimum and maximum values noted above. It will be further appreciated that the continuous monotonic function $DC_{(it)}$ may have a step change within a distance $IT_L$ of any value between any of the minimum and maximum values noted above.

According to yet other embodiments, the continuous monotonic function $DC_{(it)}$ may be a function $DC_{(it)}=[DC_0^{1/2}+(DC_s^{1/2}-DC_0^{1/2})\ it]^2$ where $DC_s$ is the dielectric constant of the core and $DC_0$ is the dielectric constant of the medium containing the radome.

According to still other embodiments, the continuous monotonic function $DC_{(it)}$ is a function $DC_{(it)}=[DC_0^{1/2}(DC_s^{1/2}-DC_0^{1/2})\cdot(A\cdot it+B\cdot it^2+C\cdot it^3)]^2$, with A+B+C=1 where $DC_s$ is the dielectric constant of the core and $DC_0$ is the dielectric constant of the medium containing the radome.

According to yet other embodiments, the continuous monotonic function $DC_{(ot)}$ is a function $DC_{(it)}=[DC_0^{1/2}(DC_s^{1/2}-DC_0^{1/2})\cdot(D\cdot it^3+E\cdot it^4+F\cdot it^5)]^2$, with D+E+F=1 where $DC_s$ is the dielectric constant of the core and $DC_0$ is the dielectric constant of the medium containing the radome.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiment 1

A radome comprising: a core, and an outer dielectric constant (ODC) adaptation component overlying an outer surface of the core, wherein the ODC adaptation component has an effective dielectric constant variation profile from an outer surface of the ODC adaptation component, through the ODC adaptation component to an outer surface of core; wherein the effective dielectric constant variation profile of the ODC adaptation component is a continuous monotonic function $DC_{(ot)}$, where $DC_{(ot)}$ is the dielectric constant of the ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

Embodiment 2

The radome of embodiment 1, wherein the radome has an incident angle reflection loss of not greater than about 3 dB as measured over an incident angle range between 0° and 60°, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 3

The radome of embodiment 1, wherein the radome has a frequency range reflection loss of not greater than about 3 dB as measured over a 40 GHz frequency range, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 4

The radome of embodiment 1, wherein the continuous monotonic function $DC_{(ot)}$ has a step change within a distance $OT_L$ less than 0.5*c/f, where c is the speed of light, and f is the largest operating frequency of the system.

Embodiment 5

The radome of embodiment 1, wherein the continuous monotonic function $DC_{(ot)}$ has a step change within a distance $OT_L$ not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm or not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or not greater than about 0.1 mm.

Embodiment 6

The radome of embodiment 1, wherein the continuous monotonic function $DC_{(ot)}$ is a function $DC_{(ot)}=[DC_0^{1/2}+(DC_s^{1/2}-DC_0^{1/2})\cdot ot]^2$ where $DC_s$ is the dielectric constant of the core and $DC_0$ is the dielectric constant of the medium containing the radome.

Embodiment 7

The radome of embodiment 1, wherein the continuous monotonic function $DC_{(ot)}$ is a function $DC_{(ot)}+[DC_0^{1/2}+DC_S^{1/2}-DC_0^{1/2})\cdot(A\cdot ot+B\cdot ot^2+C\cdot ot^3)]^2$, with A+B+C=1 where $DC_s$ is the dielectric constant of the core and $DC_0$ is the dielectric constant of the medium containing the radome.

Embodiment 8

The radome of embodiment 1, wherein the continuous monotonic function $DC_{(ot)}$ is a function $DC_{(ot)}=[DC_0^{1/2}+(DC_s^{1/2}-DC_0^{1/2})\cdot(D\cdot ot^3+E\cdot ot^4+F\cdot ot^5)]^2$, with D+E+F=1 where $DC_s$ is the dielectric constant of the core and $DC_0$ is the dielectric constant of the medium containing the radome.

Embodiment 9

The radome of embodiment 1, wherein the ODC adaptation component comprises an outer dielectric stack overlying the outer surface of the core.

Embodiment 10

The radome of embodiment 9, wherein the outer dielectric stack is configured to create the effective dielectric constant variation profile of the ODC adaptation component.

Embodiment 11

The radome of embodiment 1, wherein the ODC adaptation component is a textured outer surface of the core.

Embodiment 12

The radome of embodiment 11, wherein the texture outer surface of the core is configured to create the effective dielectric constant variation profile of the ODC adaptation component.

Embodiment 13

The radome of embodiment 1, wherein the radome further comprises: an inner dielectric constant (IDC) adaptation component overlying an inner surface of the core, wherein the ODC adaptation component has an effective dielectric constant variation profile from an inner surface IDC adaptation component, through the IDC adaptation component to an inner surface of core; wherein the effective dielectric constant variation profile of the ODC adaptation component is a continuous monotonic function $DC_{(it)}$, where $DC_{(it)}$ is the dielectric constant of IDC adaptation component at the value it, where it is a ratio $IT_L/IT_T$, $IT_L$ is a location within the IDC variation component measured from the inner surface of the IDC variation component, and $IT_T$ is the total thickness of the IDC adaptation.

Embodiment 14

The radome of embodiment 13, wherein the radome has an incident angle reflection loss of not greater than about 3 dB as measured over an incident angle range between 0° and 60°, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 15

The radome of embodiment 13, wherein the radome has a frequency range reflection loss of not greater than about 3 dB as measured over a 40 GHz frequency range, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 16

The radome of embodiment 13, wherein the continuous monotonic function $DC_{(it)}$ has a step change within a distance $IT_L$ less than 0.5*c/f, where c is the speed of light, and f is the largest operating frequency of the system.

Embodiment 17

The radome of embodiment 13, wherein the continuous monotonic function $DC_{(it)}$ has a step change within a distance $IT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm or not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or not greater than about 0.1 mm.

Embodiment 18

The radome of embodiment 13, wherein continuous monotonic function $DC_{(it)}$ is a function $DC_{(it)}=[DC_0^{1/2}+(DC_s^{1/2}-DC_0^{1/2})\,it]^2$ where $DC_s$ is the dielectric constant of the core and $DC_0$ is the dielectric constant of the medium containing the radome.

Embodiment 19

The radome of embodiment 13, wherein continuous monotonic function $DC_{(it)}$ is a function $DC_{(it)}=[DC_0^{1/2}+(DC_s^{1/2}-DC_0^{1/2})\cdot(A\cdot it+B\cdot it^2+C\cdot it^3)]^2$, with A+B+C=1 where $DC_s$ is the dielectric constant of the core and $DC_0$ is the dielectric constant of the medium containing the radome.

Embodiment 20

The radome of embodiment 13, wherein continuous monotonic function $DC_{(it)}$ is a function $DC_{(it)}=[DC_0^{1/2}+(DC_s^{1/2}-DC_0^{1/2})\cdot(D\cdot it^3+E\cdot it^4+F\cdot it^5)]^2$, with D+E+F=1 where $DC_s$ is the dielectric constant of the core and $DC_0$ is the dielectric constant of the medium containing the radome.

Embodiment 21

The radome of embodiment 13, wherein the IDC adaptation component comprises an inner dielectric stack overlying the inner surface of the core.

Embodiment 22

The radome of embodiment 21, wherein the inner dielectric stack is configured to create the effective dielectric constant variation profile of the IDC adaptation component.

Embodiment 23

The radome of embodiment 13, wherein the IDC adaptation component is a textured inner surface of the core.

Embodiment 24

The radome of embodiment 23, wherein the texture inner surface of the core is configured to create the effective dielectric constant variation profile of the IDC adaptation component.

Embodiment 25

A radome comprising: a core having a dielectric constant $ODC_{(C)}$, and an outer dielectric constant (ODC) adaptation component overlying an outer surface of the core, wherein the ODC adaptation component comprises an outer dielectric stack having N dielectric layers having varying dielectric constants $ODC_{(N)}$, wherein the dielectric constants $ODC_{(N)}$ of each successive layer from an outer most dielectric layer to a dielectric layer contacting the outer surface of the core increases from the dielectric constant of air $ODC_{(A)}$ to $ODC_{(C)}$ according to a continuous monotonic function $ODC_{(N)}$, where $ODC_{(N)}$ is the dielectric constant of an Nth dielectric layer, where N is dielectric layer number counting inwards from the outside of the ODC adaptation component.

Embodiment 26

The radome of embodiment 25, wherein the radome has an incident angle reflection loss of not greater than about 3 dB as measured over an incident angle range between 0° and 60°, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 27

The radome of embodiment 25, wherein the radome has a frequency range reflection loss of not greater than about 3 dB as measured over a 40 GHz frequency range, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 28

The radome of embodiment 25, wherein the continuous monotonic function $ODC_{(N)}$ has a step change within a distance less than 0.5*c/f, where c is the speed of light, and f is the largest operating frequency of the system.

Embodiment 29

The radome of embodiment 25, wherein the continuous monotonic function $ODC_{(N)}$ has a step change within a distance of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm or not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or not greater than about 0.1 mm.

Embodiment 30

The radome of embodiment 25, wherein the continuous monotonic function $ODC_{(N)}$ is a function $ODC_{(N)}=[ODC_0^{1/2}+(ODC_s^{1/2}-ODC_0^{1/2})\cdot N]^2$ where $ODC_S$ is the dielectric constant of the core and $ODC_0$ is the dielectric constant of the medium containing the radome.

Embodiment 31

The radome of embodiment 25, wherein the continuous monotonic function $ODC_{(N)}$ is a function $ODC_{(N)}=[ODC_0^{1/2}+(ODC_S^{1/2}-ODC_0^{1/2})\cdot(A\cdot N+B\cdot N^2+C\cdot N^3)]^2$, with A+B+C=1 where $ODC_s$ is the dielectric constant of the core and $ODC_0$ is the dielectric constant of the medium containing the radome.

Embodiment 32

The radome of embodiment 25, wherein the continuous monotonic function $ODC_{(N)}$ is a function $ODC_{(N)}=[ODC_0^{1/2}+(ODC_S^{1/2}-ODC_0^{1/2})\cdot(D\cdot N^3+E\cdot N^4+F\cdot N^5)]^2$, with D+E+F=1 where $ODC_s$ is the dielectric constant of the core and $ODC_0$ is the dielectric constant of the medium containing the radome.

Embodiment 33

The radome of embodiment 25, wherein the radome further comprises an inner dielectric constant (IDC) adaptation component overlying an inner surface of the core, wherein the IDC adaptation component comprises an inner dielectric stack having N dielectric layers having varying dielectric constants $IDC_{(N)}$, wherein the dielectric constants $IDC_{(N)}$ of each successive layer from an outer most dielectric layer to a dielectric layer contacting the outer surface of the core increases from the dielectric constant of air $IDC_{(A)}$ to $IDC_{(C)}$ according to a continuous monotonic function $IDC_{(N)}$, where $IDC_{(N)}$ is the dielectric constant of an Nth dielectric layer, where N is dielectric layer number counting inwards from the inner surface of the core to an inner surface of the IDC adaptation component.

Embodiment 34

The radome of embodiment 33, wherein the radome has an incident angle reflection loss of not greater than about 3 dB as measured over an incident angle range between 0° and 60°, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 35

The radome of embodiment 33, wherein the radome has a frequency range reflection loss of not greater than about 3 dB as measured over a 40 GHz frequency range, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 36

The radome of embodiment 33, wherein the continuous monotonic function $DC_{(it)}$ has a step change within a distance $IT_L$ less than 0.5*c/f, where c is the speed of light, and f is the largest operating frequency of the system.

Embodiment 37

The radome of embodiment 33, wherein the continuous monotonic function $DC_{(it)}$ has a step change within a distance $IT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm or not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or not greater than about 0.1 mm.

Embodiment 38

The radome of embodiment 33, wherein the continuous monotonic function $IDC_{(N)}$ is a function $IDC_{(N)}=[IDC_0^{1/2}+(IDC_S^{1/2}-IDC_0^{1/2})\cdot N]^2$ where $IDC_s$ is the dielectric constant of the core and $IDC_0$ is the dielectric constant of the medium containing the radome.

Embodiment 39

The radome of embodiment 33, wherein the continuous monotonic function $IDC_{(N)}$ is a function $IDC_{(N)}=[IDC_0^{1/2}+(IDC_S^{1/2}-IDC_0^{1/2})\cdot(A\cdot N+B\cdot N^2+C\cdot N^3)]^2$, with $A+B+C=1$ where $IDC_s$ is the dielectric constant of the core and $IDC_0$ is the dielectric constant of the medium containing the radome.

Embodiment 40

The radome of embodiment 33, wherein the continuous monotonic function $ODC_{(N)}$ is a function $IDC_{(N)}=[IDC_0^{1/2}+(IDC_S^{1/2}-IDC_0^{1/2})\cdot(D\cdot N^3+E\cdot N^4+F\cdot N^5)]^2$, with $D+E+F=1$ where $IDC_s$ is the dielectric constant of the core and $ODC_0$ is the dielectric constant of the medium containing the radome.

Embodiment 41

A radome comprising: a core having a dielectric constant $ODC_{(C)}$, and an outer dielectric constant (ODC) adaptation component overlying an outer surface of the core, wherein the ODC adaptation component comprises a textured outer surface of the core; wherein the textured outer surface comprises pyramidal profile having a period p and a height h and being configured create an effective dielectric constant variation profile of the ODC adaptation component is a continuous monotonic function $DC_{(ot)}$, where $DC_{(ot)}$ is the dielectric constant of ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

Embodiment 42

The radome of embodiment 41, wherein the radome has an incident angle reflection loss of not greater than about 3 dB as measured over an incident angle range between 0° and 60°, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 43

The radome of embodiment 41, wherein the radome has a frequency range reflection loss of not greater than about 3 dB as measured over a 40 GHz frequency range, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 44

The radome of embodiment 41, wherein the continuous monotonic function $DC_{(ot)}$ has a step change within a distance less than 0.5*c/f, where c is the speed of light, and f is the largest operating frequency of the system.

Embodiment 45

The radome of embodiment 41, wherein the continuous monotonic function $DC_{(ot)}$ has a step change within a distance $OT_L$ not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm or not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or not greater than about 0.1 mm.

Embodiment 46

The radome of embodiment 41, wherein the continuous monotonic function $DC_{(ot)}$ is a function $DC_{(ot)}=[DC_0^{1/2}+(DC_s^{1/2}-DC_0^{1/2})\cdot ot]^2$ where $DC_s$ is the dielectric constant of the core and $DC_0$ is the dielectric constant of the medium containing the radome.

Embodiment 47

The radome of embodiment 41, wherein the continuous monotonic function $DC_{(ot)}$ is a function $DC_{(ot)}=[DC_0^{1/2}+(DC_0^{1/2}-DC_0^{1/2})\cdot(A\cdot ot+B\cdot ot^2+C\cdot ot^3)]^2$, with $A+B+C=1$ where $DC_s$ is the dielectric constant of the core and $DC_0$ is the dielectric constant of the medium containing the radome.

Embodiment 48

The radome of embodiment 41, wherein the continuous monotonic function $DC_{(ot)}$ is a function $DC_{(ot)}=[DC_0^{1t2}+(DC_s^{1/2}-DC_0^{1/2})\cdot(D\cdot ot^3+E\cdot ot^4+F\cdot ot^5)]^2$, with $D+E+F=1$ where $DC_s$ is the dielectric constant of the core and $DC_0$ is the dielectric constant of the medium containing the radome.

Embodiment 49

The radome of embodiment 41, wherein the radome further comprises an inner dielectric constant (IDC) adaptation component overlying an outer surface of the core, wherein the IDC adaptation component comprises a textured inner surface of the core; wherein the textured inner surface comprises pyramidal profile having a period p and a height h and being defined based on a continuous monotonic function $DC_{(it)}$, where $DC_{(it)}$ is the dielectric constant of IDC adaptation component at the value it, where it is a ratio $IT_L/IT_T$, $IT_L$ is a location within the IDC variation component measured from the inner surface of the IDC variation component, and $IT_T$ is the total thickness of the IDC adaptation.

Embodiment 50

The radome of embodiment 49, wherein the radome has an incident angle reflection loss of not greater than about 3 dB as measured over an incident angle range between 0° and 60°, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 51

The radome of embodiment 49, wherein the radome has a frequency range reflection loss of not greater than about 3 dB as measured over a 40 GHz frequency range, not greater than about 2.9 dB or not greater than about 2.8 dB or not greater than about 2.7 dB or not greater than about 2.6 dB or not greater than about 2.5 dB or not greater than about 2.4 dB or not greater than about 2.3 dB or not greater than about 2.2 dB or not greater than about 2.1 dB or not greater than about 2.0 dB or not greater than about 1.9 dB or not greater than about 1.8 dB or not greater than about 1.7 dB or not greater than about 1.6 dB or not greater than about 1.5 dB or not greater than about 1.4 dB or not greater than about 1.3 dB or not greater than about 1.2 dB or not greater than about 1.1 dB or not greater than about 1.0 dB.

Embodiment 52

The radome of embodiment 49, wherein the continuous monotonic function $DC_{(it)}$ has a step change within a distance $IT_L$ less than 0.5*c/f, where c is the speed of light, and f is the largest operating frequency of the system.

Embodiment 53

The radome of embodiment 49, wherein the continuous monotonic function $DC_{(it)}$ has a step change within a distance $IT_L$ of not greater than about 3.0 mm or not greater than about 2.9 mm or not greater than about 2.8 mm or not greater than about 2.7 mm or not greater than about 2.6 mm or not greater than about 2.5 mm or not greater than about 2.4 mm or not greater than about 2.3 mm or not greater than about 2.2 mm or not greater than about 2.1 mm or not greater than about 2.0 mm or not greater than about 1.9 mm or not greater than about 1.8 mm or not greater than about 1.7 mm or not greater than about 1.6 mm or not greater than about 1.5 mm or not greater than about 1.4 mm or not greater than about 1.3 mm or not greater than about 1.2 mm or not greater than about 1.1 mm or not greater than about 1.0 mm or not greater than about 0.9 mm or not greater than about 0.8 mm or not greater than about 0.7 mm or not greater than about 0.6 mm or not greater than about 0.5 mm or not greater than about 0.4 mm or not greater than about 0.3 mm or not greater than about 0.2 mm or not greater than about 0.1 mm.

Embodiment 54

The radome of embodiment 49, wherein continuous monotonic function $DC_{(it)}$ is a function $DC_{(it)}=[DC_0^{1/2}+(DC_s^{1/2}-DC_0^{1/2})\,it]^2$ where $DC_s$ is the dielectric constant of the core and $DC_0$ is the dielectric constant of the medium containing the radome.

Embodiment 55

The radome of embodiment 49, wherein continuous monotonic function $DC_{(it)}$ is a function $DC_{(it)}=[DC_0^{1/2}(DC_s^{1/2}-DC_0^{1/2})\cdot(A\cdot it+B\cdot it^2+C\cdot it^3)]^2$, with A+B+C=1 where $DC_s$ is the dielectric constant of the core and $DC_0$ is the dielectric constant of the medium containing the radome.

Embodiment 56

The radome of embodiment 49, wherein continuous monotonic function $DC_{(it)}$ is a function $DC_{(it)}=[DC_0^{1/2}+(DC_s^{1/2}-DC_0^{1/2})\cdot(D\cdot it^3+E\cdot it^4+F\cdot it^5)]^2$, with D+E+F=1 where $DC_s$ is the dielectric constant of the core and $DC_0$ is the dielectric constant of the medium containing the radome.

EXAMPLES

The concepts described herein will be further described in the following Examples, which do not limit the scope of the invention described in the claims.

Example 1

A sample radome S1 designed according to embodiments described herein was simulated using a basic radome. The sample radome S1 included a core, and an ODC adaptation component. The ODC adaptation component included a multilayer dielectric stack with 20 layers having varying dielectric constants. The multilayer dielectric stack of the ODC adaptation component had a total height of 12 mm and each layer of the multilayer dielectric stack has a constant thickness of 0.6 mm. The dielectric constants of each layer of the stack varied from the outside of the ODC adaptation to the outer surface of the core according to the continuous monotonic function $ODC_{(N)}=[ODC_0^{1/2}+(ODC_S^{1/2}-ODC_0^{1/2})\cdot(D\cdot N^3+E\cdot N^4+F\cdot N^5)]^2$, with D+E+F=1 where $ODC_s$ is the dielectric constant of the core and $ODC_0$ is the dielectric constant of the medium containing the radome, which in this case was Air.

Figure 4A:
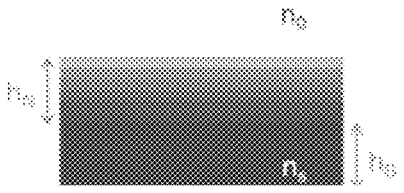
FIG. 4*a* includes an illustration of a radome structure according to another embodiment described herein.

FIG. 4 includes an illustration of the configuration of the sample radome 51.

The dielectric constants for each of the layers in the dielectric stack of the ODC adaptation component are summarized in Table 1 below.

TABLE 1

Dielectric Constant Summary for ODC Adaptation of Sample Radome S2

| Layer Number (N) | Dielectric Constant |
|---|---|
| 20 | 1 |
| 19 | 1.001 |
| 18 | 1.003 |
| 17 | 1.01 |
| 16 | 1.022 |
| 15 | 1.041 |
| 14 | 1.069 |
| 13 | 1.106 |
| 12 | 1.153 |
| 11 | 1.209 |
| 10 | 1.273 |
| 9 | 1.342 |
| 8 | 1.416 |
| 7 | 1.49 |
| 6 | 1.562 |
| 5 | 1.63 |
| 4 | 1.693 |
| 3 | 1.746 |
| 2 | 1.792 |
| 1 | 1.839 |

The radome design of sample radome S1 was simulated to evaluate its performance with regards to transmission loss. Table 2 summarizes the results of the simulation.

TABLE 2

Transmission Loss Summary for Sample S1

| Frequency (GHz) | Incident Angle (°) | Transmission Loss (Db) |
|---|---|---|
| 20 | 0 | −1.9 |
| 20 | 60 | −3 |
| 40 | 0 | −1.9 |
| 40 | 30 | −2 |
| 40 | 60 | −3.6 |

Example 2

A sample radome S2 designed according to embodiments described herein was simulated using a basic radome. The sample radome S2 included a core, an ODC adaptation component and an IDC adaptation component. The ODC adaptation component and the IDC adaptation component both included a multilayer dielectric stack with 20 layers having varying dielectric constants. The multilayer dielectric stacks of both the ODC adaptation component and the IDC adaptation component had a total height of 12 mm each layer of the multilayer dielectric stack has a constant thickness of 0.6 mm. The dielectric constants of each layer of the stacks varied from the outside of the ODC adaptation component of the IDC adaptation component to the outer surface or inner surface of the core, respectively, according to the continuous monotonic function $ODC_{(N)}=[ODC_0^{1/2}+(ODC_S^{1/2}-ODC_0^{1/2})\cdot(D\cdot N^3+E\cdot N^4+F\cdot N^5)]^2$, with D+E+F=1 where $ODC_s$ is the dielectric constant of the core and $ODC_0$ is the dielectric constant of the medium containing the radome, which in this case was Air.

Figure 4B:
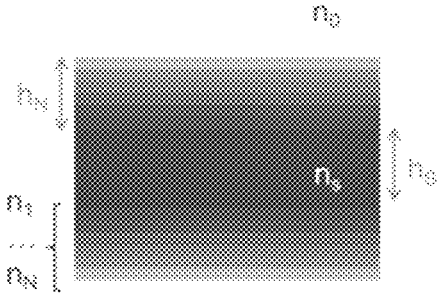
FIG. 4*b* includes an illustration of a radome structure according to another embodiment described herein.

FIG. 4*b* includes an illustration of the configuration of the sample radome S2.

The dielectric constants for each of the layers in the dielectric stacks of the ODC adaptation component and the IDC adaptation component are summarized in Table 3 below.

TABLE 3

Dielectric Constant Summary for ODC Adaptation and IDC Adaptation component of Sample Radome S2

| Layer Number (N) | Dielectric Constant |
|---|---|
| 20 | 1 |
| 19 | 1.001 |
| 18 | 1.003 |
| 17 | 1.01 |
| 16 | 1.022 |
| 15 | 1.041 |
| 14 | 1.069 |
| 13 | 1.106 |
| 12 | 1.153 |
| 11 | 1.209 |
| 10 | 1.273 |
| 9 | 1.342 |
| 8 | 1.416 |
| 7 | 1.49 |
| 6 | 1.562 |
| 5 | 1.63 |
| 4 | 1.693 |
| 3 | 1.746 |
| 2 | 1.792 |
| 1 | 1.839 |

The radome design of sample radome S2 was simulated to evaluate its performance with regards to transmission loss. Table 4 summarizes the results of the simulation.

TABLE 4

Transmission Loss Summary for Sample S1

| Frequency (GHz) | Incident Angle (°) | Transmission Loss (Db) |
|---|---|---|
| 20 | 0 | −0.9 |
| 20 | 60 | −1.5 |
| 40 | 0 | −1.6 |
| 40 | 30 | −1.7 |
| 40 | 60 | −2.3 |

Example 3

A sample radome S3 designed according to embodiments described herein was simulated using a basic radome. The sample radome S3 included a core, and an ODC adaptation component. The ODC adaptation component included a textured surface with a texture height h of 12 mm and a texture period p of 2.5 mm. The textured surface of the ODC adaptation component was designed to follow an effective dielectric constant variation profile having the continuous monotonic function $DC_{(ot)}=[DC_0^{1/2}+(DC_s^{1/2}-DC_0^{1/2})\cdot(D\cdot ot^3+E\cdot ot^4+F\cdot ot^5)]^2$, with D+E+F=1 where $DC_s$ is the dielectric constant of the core and $DC_0$ is the dielectric constant of the medium containing the radome.

Figure 5A:
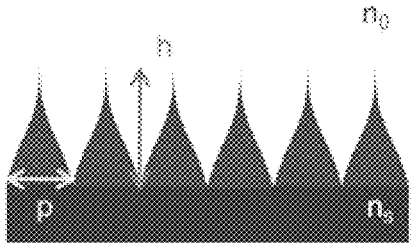
FIG. 5*a* includes an illustration of a radome structure according to another embodiment described herein.

FIG. 5*a* includes an illustration of the configuration of the sample radome S3.

The radome design of sample radome S3 was simulated to evaluate its performance with regards to transmission loss. Table 5 summarizes the results of the simulation.

TABLE 5

Transmission Loss Summary for Sample S5

| Frequency (GHz) | Incident Angle (°) | Transmission Loss (Db) |
|---|---|---|
| 20 | 0 | −1.6 |
| 20 | 60 | −2.3 |
| 40 | 0 | −2.2 |
| 40 | 30 | −2.3 |
| 40 | 60 | −3 |

Example 4

A sample radome S4 designed according to embodiments described herein was simulated using a basic radome. The sample radome S4 included a core, an ODC adaptation component, and an IDC adaptation component. The ODC adaptation component and the IDC adaptation component both included a textured surface with a texture height h of 12 mm and a texture period p of 2.5 mm. The textured surfaces of both the ODC adaptation component and the IDC adaptation component were designed to follow an effective dielectric constant variation profile having the continuous monotonic function $DC_{(ot)}=[DC_0^{1/2}+(DC_s^{1/2}-DC_0^{1/2})\cdot(D\cdot ot^3+E\cdot ot^4+F\cdot ot^5)]^2$, with D+E+F=1 where $DC_s$ is the dielectric constant of the core and $DC_0$ is the dielectric constant of the medium containing the radome.

Figure 5B:
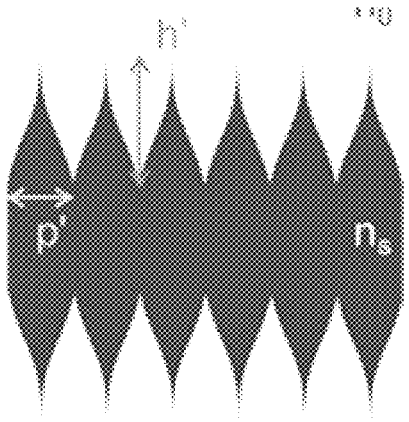
FIG. 5*b* includes an illustration of a radome structure according to another embodiment described herein.

FIG. 5*b* includes an illustration of the configuration of the sample radome S4.

The radome design of sample radome S4 was simulated to evaluate its performance with regards to transmission loss. Table 6 summarizes the results of the simulation.

TABLE 6

Transmission Loss Summary for Sample S6

| Frequency (GHz) | Incident Angle (°) | Transmission Loss (Db) |
|---|---|---|
| 20 | 0 | −0.8 |
| 20 | 60 | −1.6 |
| 40 | 0 | −1.8 |
| 40 | 30 | −1.9 |
| 40 | 60 | −2.2 |

Example 5

For purposes of comparison, an additional comparison radome design CS1 was also simulated using a basic radome shape. Comparison radome CS1 has a structure as summarized in Table 7 below.

TABLE 7

CS1 Structure Summary

| Stack | Thickness (mm) | Dielectric Constant | LT |
|---|---|---|---|
| Urethane Paint | 0.0762 | 3 | 0.03 |
| Gray Primer | 0.0254 | 4.74 | 0.03 |
| Desoto Anti-Static | 0.0203 | 6 | 0.06 |
| Aeroglaze K3425 | 0.1016 | 4.39 | 0.028 |
| Af126 Film ADH | 0.0508 | 2.67 | 0.018 |
| Epoxy/4581 | 0.5842 | 3.37 | 0.011 |
| TCF4025 | 0.889 | 1.78 | 0.012 |
| AF126 Film | 0.0508 | 2.67 | 0.018 |
| Epoxy/4581 | 2.032 | 3.37 | 0.011 |

TABLE 7-continued

| CS1 Structure Summary | | | |
|---|---|---|---|
| Stack | Thickness (mm) | Dielectric Constant | LT |
| TCF4025 | 0.889 | 1.78 | 0.012 |
| AF126 Film ADH | 0.0508 | 2.67 | 0.018 |
| Epoxy/4581 | 0.5842 | 3.37 | 0.011 |

The radome design of sample radome S4 was simulated to evaluate its performance with regards to transmission loss. Table 8 summarizes the results of the simulation.

TABLE 8

| Transmission Loss Summary for Sample S6 | | |
|---|---|---|
| Frequency (GHz) | Incident Angle (°) | Transmission Loss (Db) |
| 20 | 0 | −0.5 |
| 20 | 60 | −1 |
| 40 | 0 | −5.1 |
| 40 | 30 | −4.2 |
| 40 | 60 | −2.3 |

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A radome comprising:

a core, and an outer dielectric constant (ODC) adaptation component overlying an outer surface of the core, wherein the ODC adaptation component has an effective dielectric constant variation profile from an outer surface of the ODC adaptation component, through the ODC adaptation component to an outer surface of core;

wherein the effective dielectric constant variation profile of the ODC adaptation component is a continuous monotonic function $DC_{(ot)}$, where $DC_{(ot)}$ is the dielectric constant of the ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

2. The radome of claim 1, wherein the radome has an incident angle reflection loss of not greater than about 3 dB as measured over an incident angle range between 0° and 60.

3. The radome of claim 1, wherein the radome has a frequency range reflection loss of not greater than about 3 dB as measured over a 40 GHz frequency range.

4. The radome of claim 1, wherein the continuous monotonic function $DC_{(ot)}$ has a step change within a distance $OT_L$ less than 0.5*c/f, where c is the speed of light, and f is the largest operating frequency of the system.

5. The radome of claim 1, wherein the continuous monotonic function $DC_{(ot)}$ has a step change within a distance $OT_L$ not greater than about 3.0 mm.

6. The radome of claim 1, wherein the continuous monotonic function $DC_{(ot)}$ is a function $DC_{(ot)}=[DC_0^{1/2}+(DC_s^{1/2}-DC_0^{1/2})\cdot ot]^2$ where $DC_s$ is the dielectric constant of the core and $DC_0$ is the dielectric constant of the medium containing the radome.

7. The radome of claim 1, wherein the continuous monotonic function $DC_{(ot)}$ is a function $DC_{(ot)}=[DC_0^{1/2}+(DC_s^{1/2}-DC_0^{1/2})\cdot(A\cdot ot+B\cdot ot^2+C\cdot ot^3)]^2$, with $A+B+C=1$ where $DC_s$ is the dielectric constant of the core and $DC_0$ is the dielectric constant of the medium containing the radome.

8. The radome of claim 1, wherein the continuous monotonic function $DC_{(ot)}$ is a function $DC_{(ot)}=[DC_0^{1/2}+(DC_S^{1/2}-DC_0^{1/2})\cdot(D\cdot ot^3+E\cdot ot^4+F\cdot ot^5)]^2$, with $D+E+F=1$ where $DC_s$ is the dielectric constant of the core and $DC_0$ is the dielectric constant of the medium containing the radome.

9. The radome of claim 1, wherein the ODC adaptation component comprises an outer dielectric stack overlying the outer surface of the core.

10. The radome of claim 9, wherein the outer dielectric stack is configured to create the effective dielectric constant variation profile of the ODC adaptation component.

11. The radome of claim 1, wherein the ODC adaptation component is a textured outer surface of the core.

12. The radome of claim 11, wherein the texture outer surface of the core is configured to create the effective dielectric constant variation profile of the ODC adaptation component.

13. The radome of claim 1, wherein the radome further comprises:

an inner dielectric constant (IDC) adaptation component overlying an inner surface of the core, wherein the ODC adaptation component has an effective dielectric constant variation profile from an inner surface IDC adaptation component, through the IDC adaptation component to an inner surface of core;

wherein the effective dielectric constant variation profile of the ODC adaptation component is a continuous monotonic function $DC_{(it)}$, where $DC_{(it)}$ is the dielectric constant of IDC adaptation component at the value it, where it is a ratio $IT_L/IT_T$, $IT_L$ is a location within the IDC variation component measured from the inner surface of the IDC variation component, and $IT_T$ is the total thickness of the IDC adaptation.

14. A radome comprising:

a core having a dielectric constant $ODC_{(C)}$, and an outer dielectric constant (ODC) adaptation component overlying an outer surface of the core, wherein the ODC adaptation component comprises an outer dielectric stack having N dielectric layers having varying dielectric constants $ODC_{(N)}$, wherein the dielectric constants $ODC_{(N)}$ of each successive layer from an outer most dielectric layer to a dielectric layer contacting the outer surface of the core increases from the dielectric constant of air $ODC_{(A)}$ to $ODC_{(C)}$ according to a continuous monotonic function $ODC_{(N)}$, where $ODC_{(N)}$ is the dielectric constant of an Nth dielectric layer, where N is dielectric layer number counting inwards from the outside of the ODC adaptation component.

15. A radome comprising:

a core having a dielectric constant $ODC_{(C)}$, and an outer dielectric constant (ODC) adaptation component overlying an outer surface of the core, wherein the ODC adaptation component comprises a textured outer surface of the core;

wherein the textured outer surface comprises pyramidal profile having a period p and a height h and being configured create an effective dielectric constant variation profile of the ODC adaptation component is a continuous monotonic function $DC_{(ot)}$, where $DC_{(ot)}$ is the dielectric constant of ODC adaptation component at the value ot, where ot is a ratio $OT_L/OT_T$, $OT_L$ is a location within the ODC variation component measured from the outer surface of the ODC variation component, and $OT_T$ is the total thickness of the ODC adaptation.

16. The radome of claim 15, wherein the radome has an incident angle reflection loss of not greater than about 3 dB as measured over an incident angle range between 0° and 60.

17. The radome of claim 15, wherein the radome has a frequency range reflection loss of not greater than about 3 dB as measured over a 40 GHz frequency range.

18. The radome of claim 15, wherein the ODC adaptation component comprises an outer dielectric stack overlying the outer surface of the core.

19. The radome of claim 18, wherein the outer dielectric stack is configured to create the effective dielectric constant variation profile of the ODC adaptation component.

20. The radome of claim 15, wherein the ODC adaptation component is a textured outer surface of the core.

* * * * *